US009153136B2

(12) United States Patent
Lopez Leones et al.

(10) Patent No.: US 9,153,136 B2
(45) Date of Patent: Oct. 6, 2015

(54) PROVIDING DATA FOR PREDICTING AIRCRAFT TRAJECTORY

(75) Inventors: Javier Lopez Leones, Madrid (ES); Enrique Casado, Madrid (ES); Miguel Vilaplana, Madrid (ES); Francisco A. Navarro, Madrid (ES)

(73) Assignee: The Boeing Company, Chicago, IL (US)

( * ) Notice: Subject to any disclaimer, the term of this patent is extended or adjusted under 35 U.S.C. 154(b) by 56 days.

(21) Appl. No.: 13/360,318

(22) Filed: Jan. 27, 2012

(65) Prior Publication Data

US 2012/0290154 A1 Nov. 15, 2012

(30) Foreign Application Priority Data

Jan. 28, 2011 (EP) ..... 11382020

(51) Int. Cl.
*G08G 5/00* (2006.01)

(52) U.S. Cl.
CPC ..... *G08G 5/0043* (2013.01); *G08G 5/0021* (2013.01); *G08G 5/0034* (2013.01); *G08G 5/0082* (2013.01)

(58) Field of Classification Search
CPC . G08G 5/0021; G08G 5/0034; G08G 5/0043; G08G 5/0082
USPC ..... 701/3, 4
See application file for complete search history.

(56) References Cited

U.S. PATENT DOCUMENTS

| | | | | |
|---|---|---|---|---|
| 6,314,362 | B1 * | 11/2001 | Erzberger et al. | 701/120 |
| 2004/0078136 | A1 * | 4/2004 | Cornell et al. | 701/120 |
| 2009/0319100 | A1 * | 12/2009 | Kale et al. | 701/4 |
| 2010/0305781 | A1 * | 12/2010 | Felix | 701/3 |

FOREIGN PATENT DOCUMENTS

EP 2040137 A1 3/2009

OTHER PUBLICATIONS

U.S. Department of Transportation Federal Aviation Administration, Order JO 7210.3V Facility Operation and Administration, Feb. 14, 2008, pp. 6-6-1 to 6-6-3.*

E. Gallo et al: "Advanced aircraft performance modeling for ATM: BADA 4.0 Results" [Online] 2006, pp. 1E1-1-1E1-12, XP002481137.

(Continued)

*Primary Examiner* — Fadey Jabr
*Assistant Examiner* — Aaron L Troost

(57) ABSTRACT

The present invention provides a system and method of producing a description of the flight intent of an aircraft expressed using a formal language. The description may be used to generate a predicted aircraft trajectory, for example by air traffic management. Rules are used in association with information provided to express the flight intent of the aircraft in a formal language. The flight intent describes a flight in terms of flight segments, and provides information of the path to be flown and how it is to be flown. The flight intent does not necessarily define unambiguously the aerodynamic configuration of the aircraft and the motion of the aircraft during the flight. The flight intent is used alongside other information to generate the aircraft intent that does describe unambiguously the aircraft's trajectory.

22 Claims, 4 Drawing Sheets

(56) References Cited

OTHER PUBLICATIONS

Vilaplana M. A. et al.: "Towards a Formal Language for the Common Description of Aircraft Intent," Digital Avionics Systems Conference, 2005, Dasc 2005, the 24th Washington, DC USA 30—Oct. 3, 2005, Piscataway, NJ, USA, IEEE, vol. 1, Oct. 30, 2005, pp. 3.C.5-1-3.C.5-9, XP010868246.

European Search Report dated May 26, 2008 from EP07380259.

* cited by examiner

| Types | Group | | | Instruction | | |
|---|---|---|---|---|---|---|
| | No. | Keyword | Name | No. | Keyword | Name |
| Motion instruction | 1 | SG | Speed guidance | 1 | SL | Speed law |
| | | | | 2 | HS | Hold speed |
| | 2 | HSG | Horizontal speed guidance | 3 | HSL | Horizontal speed law |
| | | | | 4 | HHS | Hold horizontal speed |
| | 3 | VSG | Vertical speed guidance | 5 | VSL | Vertical speed law |
| | | | | 6 | HVS | Hold vertical speed |
| | 4 | PAG | Path angle guidance | 7 | SPA | Set path angle |
| | | | | 8 | PAL | Path angle law |
| | | | | 9 | HPA | Hold path angle |
| | 5 | AG | Altitude guidance | 10 | AL | Altitude law |
| 260 | | | | 11 | HA | Hold altitude |
| | 6 | VPG | Vertical position guidance | 12 | TVP | Track vertical path |
| | 7 | TC | Throttle control | 13 | ST | Set throttle |
| | | | | 14 | TL | Throttle law |
| | | | | 15 | HT | Hold throttle |
| | | | | 16 | OLT | Open loop throttle |
| | 8 | LDC | Lateral directional control | 19 | SBA | Set bank angle |
| | | | | 20 | BAL | Bank angle law |
| | | | | 21 | HBA | Hold bank angle |
| | | | | 22 | OLBA | Open loop bank angle |
| | 9 | DG | Directional guidance | 17 | CL | Course law |
| | | | | 18 | HC | Hold course |
| | 10 | LPG | Lateral position guidance | 23 | THP | Track horizontal path |
| Configuration instruction | 11 | HLC | High lift configuration | 24 | SHL | Set high lift devices |
| | | | | 25 | HLL | High lift devices law |
| | | | | 26 | HHL | Hold high lift devices |
| | 12 | SBC | Speed brakes configuration | 27 | SSB | Set speed brakes |
| 270 | | | | 28 | SBL | Speed brakes law |
| | | | | 29 | HSB | Hold speed brakes |
| | | | | 30 | OLSB | Open loop speed brakes |
| | 13 | LGC | Landing gear configuration | 31 | SLG | Set landing gear |
| | | | | 32 | HLG | Hold landing gear |

FIG. 3

PROVIDING DATA FOR PREDICTING AIRCRAFT TRAJECTORY

CROSS REFERENCES TO RELATED APPLICATIONS

The Present Application claims the benefit of European Patent Application No. 11382020.3 entitled "PROVIDING DATA FOR PREDICTING AIRCRAFT TRAJECTORY" and filed on 28 Jan. 2011, the content of which is hereby incorporated herein by reference in its entirety to the extent permitted by law.

FIELD OF THE INVENTION

The present invention relates to providing data that allows the path of an aircraft to be predicted, for example during air traffic management. In particular, the present invention resides in a method of providing such data using flight intent expressed using a formal language.

BACKGROUND OF THE INVENTION

The ability to predict an aircraft's trajectory is useful for several reasons.

Air traffic management (ATM) would benefit from an improved ability to predict an aircraft's trajectory. Air traffic management is responsible for the safe separation of aircraft, a particularly demanding task in congested airspace such as around airports. ATM decision-support tools based on accurate trajectory predictions could allow a greater volume of aircraft to be handled while maintaining safety.

By trajectory, a four-dimensional description of the aircraft's path is meant. The description may be the evolution of the aircraft's state with time, where the state may include the position of the aircraft's centre of mass and other aspects of its motion such as velocity, attitude and weight. This benefit is particularly significant where ATM is operating in and around airports.

As demand for slots at airports increases, ATM is under constant pressure to increase capacity by decreasing separation between aircraft: increased accuracy in predicting aircraft trajectories enables this to be done without compromising safety. Also, greater predictability in aircraft trajectories allows arrival times to be determined more accurately thereby enabling better coordination with ground operations.

In current ATM practice, aircraft must typically fly set routes. For example, when approaching and departing an airport, aircraft are usually requested to fly a STAR (Standard Terminal Arrival Route) and a SID (Standard Instrument Departure), respectively. However, aircraft operators are requesting additional flexibility to fly according to their preferences, so that they can better pursue their business objectives.

Furthermore, there is an increasing pressure on the ATM system to facilitate the reduction of the environmental impact of aircraft operations. As a result of the above, the ATM system requires the capability to predict operator-preferred trajectories as well as trajectories that minimize the impact on the environment, chiefly in terms of noise and emissions. In addition, the ATM system must be able to exchange descriptions of such trajectories with the operators in order to arrive at a coordinated, conflict-free solution to the traffic problem.

The ability to predict an aircraft's trajectory will also be of benefit to the management of autonomous vehicles such as unmanned air vehicles (UAVs), for example in programming flight plans for UAVs as well as in commanding and deconflicting their trajectories.

In order to predict aircraft trajectory unambiguously, one must solve a set of differential equations that model both aircraft behavior and atmospheric conditions. The computation process requires inputs corresponding to the aircraft intent, as derived from flight intent.

Aircraft intent must be distinguished from flight intent. Flight intent may be thought of as a generalization of the concept of a flight plan, and so will reflect operational constraints and objectives such as intended or required route and operator preferences. Generally, flight intent will not unambiguously define an aircraft's trajectory, as the information it contains need not close all degrees of freedom of the aircraft's motion. Put another way, there are likely to be many aircraft trajectories that would satisfy a given flight intent. Thus, flight intent may be regarded as a basic blueprint for a flight, but that lacks the specific details required to compute unambiguously a trajectory.

For example, the instructions to be followed during a STAR or a SID would correspond to an example of flight intent. In addition, airline preferences may also form an example of flight intent. To determine aircraft intent, instances of flight intent like a SID procedure, the airline's operational preferences and the actual pilot's decision making process must be combined. This is because aircraft intent comprises a structured set of instructions that are used by a trajectory computation infrastructure to provide an unambiguous trajectory. The instructions should include configuration details of the aircraft (e.g. landing gear deployment), and procedures to be followed during maneuvers and normal flight (e.g. track a certain turn radius or hold a given airspeed). These instructions capture the basic commands and guidance modes at the disposal of the pilot and the aircraft's flight management system to direct the operation of the aircraft. Thus, aircraft intent may be thought of as an abstraction of the way in which an aircraft is commanded to behave by the pilot and/or flight management system. Of course, the pilot's decision making process is influenced by required procedures, for example as required to follow a STAR/SID or to comply with airline operational procedures as defined by the flight intent.

Aircraft intent is expressed using a set of parameters presented so as to allow equations of motion to be solved. The theory of formal languages may be used to implement this formulation: an aircraft intent description language provides the set of instructions and the rules that govern the allowable combinations that express the aircraft intent, and so allow a prediction of the aircraft trajectory.

SUMMARY OF THE INVENTION

Against this background and according to a first embodiment, a method of providing a description of a flight intent of an aircraft to be flown on a flight expressed using a formal language includes receiving information describing how the aircraft is to be flown including motion information that describes the motion of the aircraft and configuration information that describes an aerodynamic configuration of the aircraft, and storing the information in a database, dividing the flight onto one or more flight segments and for each flight segment, determining which degrees of freedom of motion of the aircraft are defined by the information stored for that flight segment, and expressing the flight intent for that flight segment using a formal language to define which degrees of freedom of motion of the aircraft are defined during the flight segment and which degrees of freedom of motion are not defined.

According to another embodiment, a method of predicting the trajectory of an aircraft includes reading data providing a description of flight intent expressed using a formal language, as herein described, obtaining further information such that an unambiguous description of the aircraft's trajectory during the flight is provided, expressing the aircraft intent according to a formal language thereby providing the unambiguous description of the aircraft's trajectory, solving equations of motion defining aircraft motion using the expression of aircraft intent and with reference to an aircraft performance model and an Earth model, and providing a description of the predicted trajectory.

According to yet another embodiment, an aircraft trajectory predictor system includes a means for reading data providing a description of flight intent expressed using a formal language, a means for obtaining further information such that an unambiguous description of the aircraft's trajectory during the flight is provided, a means for expressing the aircraft intent according to a formal language thereby providing the unambiguous description of the aircraft's trajectory, a means for solving equations of motion defining aircraft motion using the expression of aircraft intent and with reference to an aircraft performance model and an Earth model, and means for providing a description of the predicted trajectory.

Other aspects of the invention, along with preferred features, are set out in the appended claims.

BRIEF DESCRIPTION OF THE DRAWINGS

In order that the present invention may be more readily understood, preferred embodiments will now be described, by way of example only, with reference to the accompanying drawings in which:

FIG. 3 is a table showing classification of instructions;

DETAILED DESCRIPTION OF THE INVENTION

Figure 1:
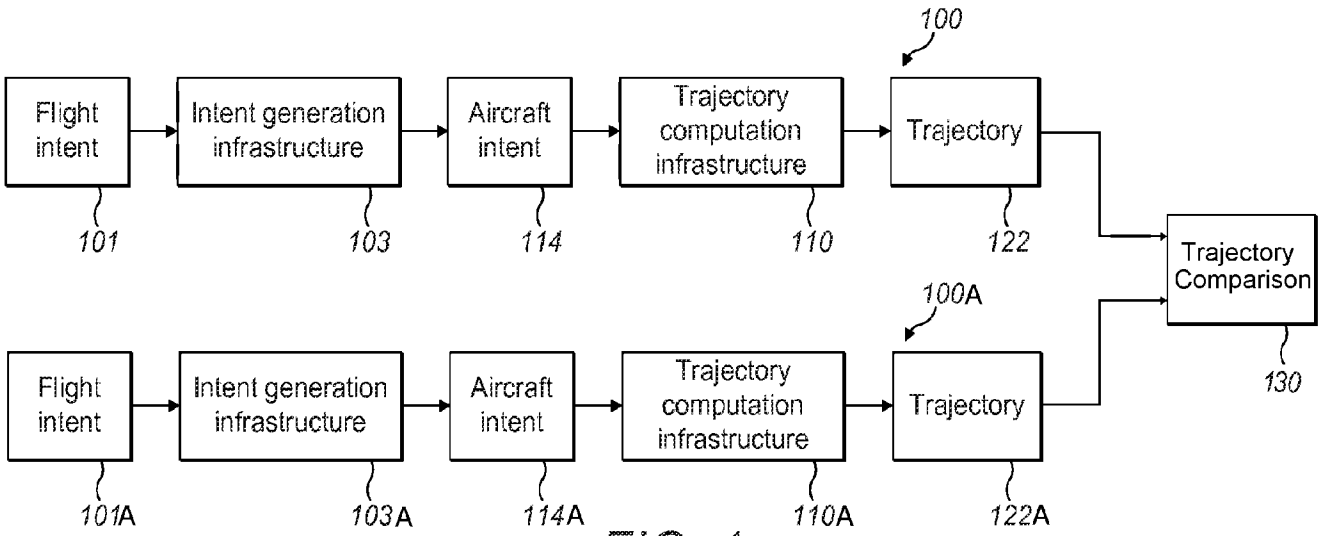
FIG. 1 is a simplified schematic representation of a system for computing an aircraft's trajectory using flight intent and aircraft intent, and for comparing the trajectories of plural aircraft.
Figure 2:
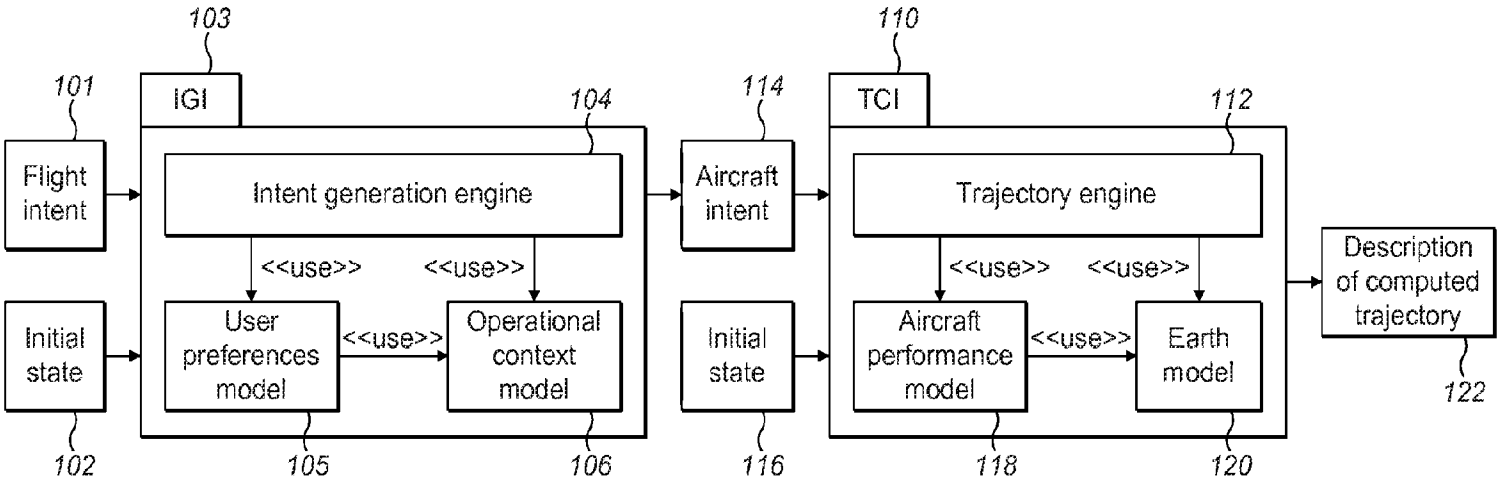
FIG. 2 is a simplified schematic representation that shows a portion of the system of FIG. 1 in greater detail.

A system for computing an aircraft's trajectory 100 is shown in FIGS. 1 and 2. US Published Patent Application Publication 20100305781 titled "PREDICTING AIRCRAFT TRAJECTORY", also in the name of The Boeing Company, describes aircraft intent in more detail, and the disclosure of this application is incorporated herein in its entirety by reference. The present patent application is concerned with flight intent.

FIG. 1 shows a basic structure of how flight intent 101 may be used to derive aircraft intent 114, and how aircraft intent 114 may be used to derive a description of the aircraft's trajectory 122. In essence, flight intent 101 is provided as an input to an intent generation infrastructure 103. The intent generation infrastructure 103 determines aircraft intent 114 using the unambiguous instructions provided by the flight intent 101 and other inputs to ensure a set of instructions is provided that will allow an unambiguous trajectory 122 to be calculated. The aircraft intent 114 output by the intent generation infrastructure 103 may then be used as an input to a trajectory computation infrastructure 110. The trajectory computation infrastructure 110 calculates an unambiguous trajectory 122 using the aircraft intent 114 and other inputs that are required to solve the equations of motion of the aircraft.

FIG. 1 additionally shows a simplified schematic representation of a specific illustrative embodiment of the invention wherein an aircraft trajectory 100A of a further aircraft (not shown) is computed to produce a corresponding unambiguous trajectory 122A for the further aircraft. In this embodiment, unambiguous trajectories 122 and 122A are computed in identical manners and compared at function block 130 to determine whether there are present any trajectory conflicts.

FIG. 2 shows the system of FIG. 1 in further detail.

As can be seen, the intent generation infrastructure 103 receives a description of the flight intent 101 as an input along with a description of the initial state 102 of the aircraft (the initial state 102 of the aircraft may be defined as part of the flight intent 101, in which case these two inputs are effectively one and the same). The intent generation infrastructure 103 comprises an intent generation engine 104 and a pair of databases, one storing a user preferences model 105 and one storing an operational context model 106.

The user preferences model 105 embodies the preferred operational strategies governing the aircraft, e.g. the preferences of an airline with respect to loads (both payload and fuel); how to react to meteorological conditions such as temperature, wind speeds, altitude, jet stream, thunderstorms and turbulence as this will affect the horizontal and vertical path of the aircraft as well as its speed profile; cost structure such as minimizing time of flight or cost of flight, maintenance costs, environmental impact; communication capabilities; and security considerations.

The operational context model 106 embodies constraints on use of airspace. The intent generation engine 104 uses the flight intent 101, initial state 102, user preferences model 105 and operational context model 106 to provide the aircraft intent 114 as its output.

FIG. 2 shows that the trajectory computation infrastructure 110 comprises a trajectory engine 112. The trajectory engine 112 requires as inputs both the aircraft intent description 114 described above and also the initial state 116 of the aircraft. The initial state 116 of the aircraft may be defined as part of the aircraft intent 114 in which case these two inputs are effectively one and the same. For the trajectory engine 112 to provide a description of the computed trajectory 122 for the aircraft, the trajectory engine 112 uses two models: an aircraft performance model 118 and an Earth model 120.

The aircraft performance model 118 provides the values of the aircraft performance aspects required by the trajectory engine 112 to integrate the equations of motion. These values depend on the aircraft type for which the trajectory is being computed, the aircraft's current motion state (position, velocity, weight, etc) and the current local atmospheric conditions.

In addition, the performance values may depend on the intended operation of the aircraft, i.e. on the aircraft intent 114. For example, a trajectory engine 112 may use the aircraft performance model 118 to provide a value of the instantaneous rate of descent corresponding to a certain aircraft weight, atmospheric conditions (pressure attitude and temperature) and intended speed schedule (e.g. constant calibrated airspeed). The trajectory engine 112 will also request from the aircraft performance model 118 the values of the applicable limitations so as to ensure that the aircraft motion remains within the flight envelope. The aircraft performance model 118 is also responsible for providing the trajectory engine 112 with other performance-related aspects that are intrinsic to the aircraft, such as flap and landing gear deployment times.

The Earth model 120 provides information relating to environmental conditions, such as the state of the atmosphere, weather conditions, gravity and magnetic variation.

The trajectory engine 112 uses the inputs, the aircraft performance model 118 and the Earth model 120 to solve a set of equations of motion. Many different sets of equations of motion are available that vary in complexity, and that may reduce the aircraft's motion to fewer degrees of freedom by means of a certain set of simplifying assumptions.

The trajectory computation infrastructure 110 may be air-based or land-based. For example, the trajectory computation infrastructure 110 may be associated with an aircraft's flight management system that controls the aircraft on the basis of a predicted trajectory that captures the airline operating preferences and business objectives. The primary role for land-based trajectory computation infrastructures 110 is for air traffic management.

Using a standardized approach to describing an aircraft's trajectory allows greater interoperability between airspace users and managers. It also allows greater compatibility between many of the legacy software packages that currently predict trajectories, even if interpreters are required to convert information from the standard format into a proprietary format.

Moreover, a standardized approach also works to the benefit of flight intent 101 and aircraft intent 114. For example, flight intent 101 may use the instructions and other structures of aircraft intent 114. In addition, flight intent 101 as disclosed herein provides a user with an extension to the aircraft intent language that allows flight intent 101 to be formulated where only certain aspects of aircraft's motion are known.

As flight intent 101 may be thought of as a broader and generalized form of aircraft intent 114, it is useful to start with a consideration of aircraft intent 114 such that key concepts also used in generating flight intent 101 may be introduced.

Aircraft Intent

In a preferred embodiment, a description of aircraft intent 114 is expressed using a formal language. Information defining how an aircraft is to be flown during a time interval is received, and a set of instructions comprising configuration instructions that describe the aerodynamic configuration of the aircraft and motion instructions that describe the motion of the aircraft are generated. A check is made to ensure that the set of instructions comply with a set of rules to ensure that the configuration instructions define the aerodynamic configuration of the aircraft and that the motion instructions close the degrees of freedom of equations of motion used to describe the aircraft motion. The aircraft intent description is an expression of a set of instructions in a formal language, an aircraft intent description language, which defines unambiguously the trajectory 122 of the aircraft. This expression is used by the trajectory computation engine 112 to solve the equations of motion that govern the aircraft's motion.

There exist in the art many different sets of equations of motion that describe an aircraft's motion. The sets of equations generally differ due to their complexity. In principle, any of these sets of equations may be used. The actual form of the equations of motion influences how the aircraft intent description language should be formulated because variables that appear in the equations of motion also appear in the instructions defining the aircraft intent 114. However, the flight intent 101 is not constrained in this way in that it may express flight intent 101 generally such that any detail specific to the particular equations of motion to be used is not specified. However, flight intent 101 may be specific to a particular set of equations of motion, and so may include the variables.

The set of equations of motion may describe the motion of the aircraft's centre of gravity, with the aircraft considered as a mass-varying rigid solid. Three coordinates may describe the position of the aircraft's centre of mass (longitude, latitude and altitude) and three values describe the aircraft's attitude (roll, pitch and yaw). To derive the equations, a set of simplifying assumptions may be applied to the general equations describing atmospheric, powered flight.

The equations of motion will include variables relating to the aircraft's performance and meteorological conditions, and these are provided by the aircraft performance model 118 and the earth model 120. To solve the equations, the configuration of the aircraft must be specified. For example, information may be required to resolve the settings of the landing gear, speed brakes and high lift devices.

US20100305781 mentioned above, describes using equations of motion that form a system of seven non-linear ordinary differential equations, along with a definition of a given aircraft configuration comprising landing gear setting, high-lift devices settings and speed brakes setting, that have one independent variable (time), ten dependent variables and hence three mathematical degrees of freedom (i.e. the number of dependent variables minus the number of equations). Thus, this choice of the equations of motion means that it is necessary to define externally the three degrees of freedom to obtain a closed solution thereby defining the aircraft trajectory unambiguously, plus three further degrees of freedom to define the aircraft's configuration (the landing gear, speed brakes and high-lift devices inputs must be closed at any time to obtain the trajectory 122).

The aircraft intent description language is a formal language whose primitives are the instructions. The grammar of the formal language provides the framework that allows instructions to be combined into sentences that describe operations. Each operation contains a complete set of instructions that close the required six degrees of freedom in the equations of motion and so unambiguously defines the aircraft trajectory 122 over its associated operation interval.

Instructions may be thought of as indivisible pieces of information that capture basic commands, guidance modes and control inputs at the disposal of the pilot and/or the flight management system. Each instruction may be characterized by three main features.

The effect of an instruction is defined by a mathematical description of its influence on the aircraft's motion. It is expressed as a mathematical equation that must be along with the equations of motion during its execution interval.

The meaning of an instruction is given by its intrinsic purpose and is related to the operational purpose of the command, guidance mode or control input captured by the instruction.

The execution interval is the period during which the instruction is affecting the aircraft's motion, i.e. the time during which the equations of motion and the instruction's effect must be simultaneously satisfied. The execution of different instructions may overlap, and such instructions are said to be compatible. Other instructions are incompatible, and so cannot have overlapping execution intervals (e.g. instructions that cause a conflicting requirement for the aircraft to ascend and descend).

The instructions are divided into groups, with the division primarily focusing on the effect of the instructions, and then on grouping incompatible instructions together, as shown in FIG. 3. At a top level, the instructions are divided into two groups: configuration instructions 270 and motion instructions 260.

Configuration instructions 270 relate to the aircraft's instantaneous aerodynamic configuration as determined by the high-lift devices, landing gear and speed brakes. The effect of any member of this group is the time evolution of the position of the associated components.

The first group is called high lift configuration or HLC, and comprises the instructions set high-lift devices (SHL), high-lift devices law (FILL) and hold high-lift devices (HHL).

The second group is called speed brakes configuration or SBC, and comprises the instructions set speed brakes (SSB), speed brakes law (SBL), open loop speed brakes (OLSB) and hold speed brakes (HSB).

The third group is called landing gear configuration or LGC, and comprises the instructions set landing gear (SLG) and hold landing gear (HLG).

As the configuration of the aircraft must be fully determined at all times, there must always be an active instruction from each of these groups.

Motion instructions 260 capture the flight control commands, guidance modes and navigation strategies that may be employed. The effect of a motion instruction is defined as a mathematical equation that unambiguously determines one of the degrees of freedom during the execution interval of the instruction. At any one instant, three motion instructions must be active to close the three degrees of freedom. The motion instructions are classified into ten groups according to their effect, each group containing incompatible instructions as follows.

1. Group SG—speed guidance.
   Contains speed law (SL) and hold speed (HS).
2. Group HSG—horizontal speed guidance.
   Contains horizontal speed law (HSL) and hold horizontal speed (HHS),
3. Group VSG—vertical speed guidance.
   Contains vertical speed law (VSL) and hold vertical speed (HVS).
4. Group PAG—path angle guidance.
   Contains set path angle (SPA), path angle law (PAL) and hold path angle (HPA).
5. Group LAG—local altitude guidance.
   Contains altitude law (AL) and hold altitude (HA).
6. Group VPG—vertical positional guidance.
   Contains track vertical path (TVP).
7. Group TC—throttle control.
   Contains set throttle (ST), throttle law (TL), hold throttle (HT) and open loop throttle (OLT).
8. Group LDC—lateral directional control.
   Contains set bank angle (SBA), bank angle law (BAL), hold bank angle (HBA) and open loop bank angle (OLBA).
9. Group DG—directional guidance.
   Contains course law (CL) and hold course (HC).
10. Group LPG—lateral positional guidance.
    Contains track horizontal path (THP).

The information received relating to the aircraft intent (e.g. flight intent, operator preferences, pilot selections, flying procedures, etc.) may be mapped to the instructions in the groups above. For example, a manual input throttle control will map to the TC group. Similarly, a pilot may select a climb-out procedure that contains both speed and flight path angle, thus mapping to the VSG and PAG groups, along with a bearing to maintain that will map to the LPG group.

Seven rules govern the possible combinations of instructions, as follows.

1. An operation must have six instructions (follows from 3 and 4 below).
2. Each instruction must come from a different group (as members of the same group are incompatible).
3. One instruction must come from each of HLC, LGC and SBC (e.g. the configuration instruction groups, to define the configuration of the aircraft).
4. Three instructions must come from the following groups: DG, LPG, LDC, TC, SG, HSG, VSG, PAG, AG and VPG (i.e. the motion instruction groups to close the three degrees of freedom).
5. One and only one instruction must come from DG, LPG and LDC (to avoid conflicting requirements for lateral motion).
6. Instructions from groups SG and HSG cannot be present simultaneously (to avoid conflicting requirements for speed).
7. Instructions from groups VSG, PAG, AG and VPG cannot be present simultaneously (to avoid conflicting requirements for vertical speed, path angle and altitude).

The above lexical rules capture all the possible ways of unambiguously defining the aircraft trajectory prior to computing the trajectory. Consequently, an instance of aircraft intent that complies with the above rules contains sufficient necessary information to compute a unique aircraft trajectory.

Now that a description of aircraft intent has been provided, flight intent will be considered once more.

Flight Intent

The definition of a specific aircraft trajectory is the result of a compromise between a given set of objectives and a given set of constraints. These constraints and objectives could be considered as a flight blueprint regardless of the specific aircraft behavior which should be followed in order to attain such restrictions to the trajectory. As explained above, this concept is referred to as flight intent. Importantly, flight intent does not have to determine the aircraft motion unambiguously: in principle, there may be many trajectories (possibly infinite) that fulfill the set of constraints encompassed by a given flight intent. Another way of thinking about the relationship between flight intent and aircraft intent is that an instance of flight intent will give rise to a family of aircraft intents, each instance of aircraft intent resulting in a different unambiguous trajectory. Determining a particular aircraft intent and thus the final trajectory is the responsibility of the intent generation engine 104.

As explained above, each instance of flight intent contains trajectory-related information that does not univocally determine the aircraft motion, but instead comprises of a set of high-level conditions that defines certain aspects that the aircraft should respect during its motion (e.g. following a certain route, keeping a fixed speed in a certain area). The flight intent captures key operational objectives and constraints that must be fulfilled by the trajectory (e.g. intended route, operator preferences, standard operational procedures, ATC constraints, etc.).

Considering the information that is used directly to generate the flight intent, it is possible to group similar elements into three separate structures: flight segments, operational context and user preferences.

The flight segments combine to form the flight path to be followed by the aircraft during the flight. The operational context may include the set of ATM constraints that may limit the trajectory followed by an aircraft in one or more dimensions. They may include altitude constraints, speed constraints, climb/descend constraints, heading/vectoring/route constraints, standard procedures constraints, route structures constraints, SID constraints, STAR constraints, and coordination and transfer constraints (e.g. speed and altitude ranges and the location of entrance and exit points which should be respected by any flight when it is moving from one sector to the next one). User preferences are usually directed to safety and efficiency, and generally differ from one user to another. The most common user preferences relate to: operational revenue such as maximizing payload weight, minimizing fuel consumption, minimizing over-flight fees, minimizing landing fees, minimizing maintenance costs; environmental impact such as minimizing COx and NOx emissions, minimizing noise emissions; and quality of service such as increasing passengers' comfort (e.g. avoiding sudden and extreme maneuvers) and reducing delays.

Flight Intent Description Language (FIDL)

It is proposed to represent flight intent using a formal language, composed of a non-empty finite set of symbols or letters, known as an alphabet, which are used to generate a set of strings or words. A grammar is also required, namely a set of rules governing the allowable concatenation of the alphabet into strings and the strings into sentences.

Figure 4:
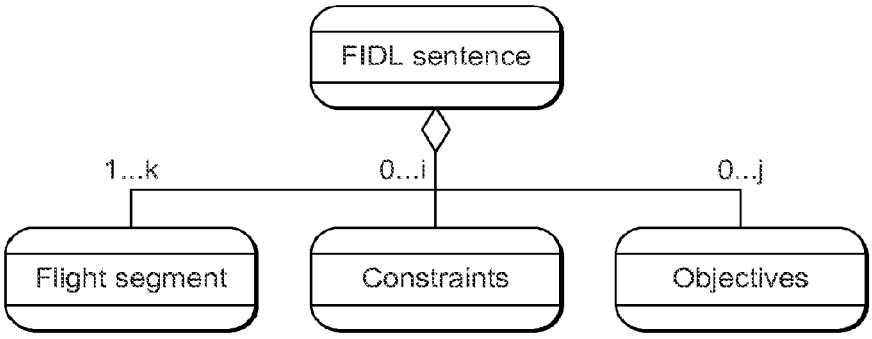
FIG. 4 shows elements of the flight intent description language.

The alphabet comprises three types of letters, as shown in FIG. 4: flight segments, constraints and objectives. A sentence is formed by the proper combination of these elements following the grammatical rules that will be described below. A sentence is an ordered sequence of flight segments, i.e. ordered according to when they occur, in which different constraints and objectives are active to influence the aircraft motion.

Flight segments, within the alphabet, represent the intent of changing the aircraft motion state from one state into another (e.g. a translation from one 3D point to another 3D point, a turning between two courses, an acceleration between two speeds or an altitude change). A flight segment may be characterized by two aircraft motion states identified by a condition or event that establishes certain requirements for the trajectory to be flown. These conditions represent the execution interval of the flight segment. The conditions may close one or more degrees of freedom of the aircraft motion during the flight segment.

Constraints represent restrictions on the trajectory, and the constraints may be achieved by making use of the open degrees of freedom that are available during the applicable flight segment(s).

Objectives represent a desire relating to the trajectory to maximize or minimize a certain functional (e.g. cruise to minimize cost). The objectives may be achieved by making use of the open degrees of freedom that are available during the applicable flight segment(s), excluding those that are used to respect the constraints affecting that flight segment(s).

Combining these three elements it is possible to build words as valid FIDL strings. For example, the flight intent information "fly from waypoint RUSIK to waypoint FTV" can be expressed by an FIDL word containing a flight segment whose initial state is defined by the coordinates of waypoint RUSIK and whose final state is defined by the coordinates of waypoint FTV. This flight intent information could be extended by a constraint such as "maintain flight level above 300 (FL300)". In the same way, it would be possible to add information to this FIDL word regarding some objectives over the trajectory. To ensure that any constraint or objective is compatible with a flight segment, the affected aspect of aircraft motion, expressed as a degree of freedom, should not have been previously closed by the flight segment. In the previous example, the flight level constraint is compatible with the flight segment because the flight segment does not define any vertical behavior. However, if the flight segment explicitly indicates that the aircraft is to descend at constant path angle between RUSIK and FTV, then the vertical degree of freedom is closed and the constraint cannot be allowed. Therefore, the FIDL lexical rules to be described below forbid the constraint.

Often constraints and objectives will extend over a sequence of flight segments. A constraint or objective may be associated to a set of consecutive flight segments that it might affect. This means that the constraint or Objective may be considered in the aircraft intent generation process as soon as the initial state of the first flight segment is achieved and up until the final state of the last flight segment. This does not imply that the constraint or objective is affecting all the flight segments, but rather than the constraint or objective is taken into account for all flight segments and may or may not be affect the aircraft's motion in any particular flight segment.

Figure 5:
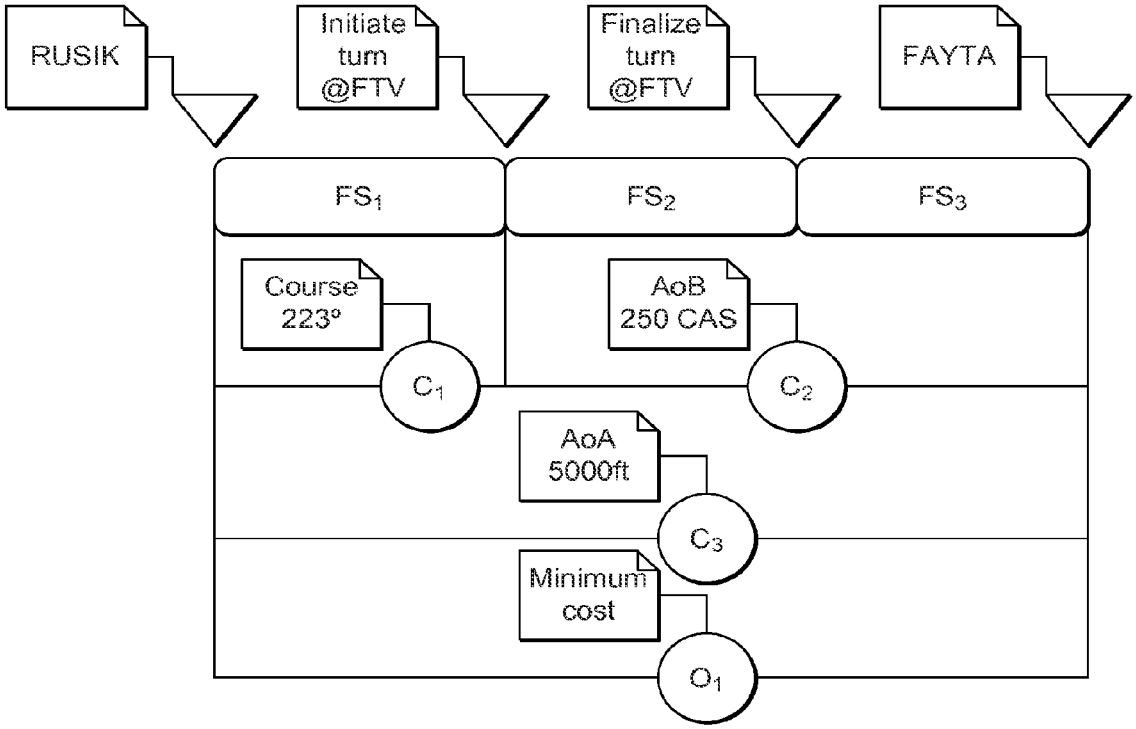
FIG. 5 is an example of a flight intent instance described using flight intent description language elements.

FIG. 5 shows a graphical representation of an example FIDL sequence expressed using the above mentioned three elements. The figure represents the intention of flying from waypoint RUSK to waypoint FAYTA by performing a turn en route at waypoint FTV. The sequence is formed by:

Flight Segments $FS_1$ between the initial state defined by the waypoint RUSIK and the final state defined by the beginning of the turn maneuver at waypoint FTV.

$FS_2$ between the beginning and end of the turn maneuver at waypoint FTV.

$FS_3$ between the initial state defined by the end of the turn maneuver at waypoint FTV and the final state defined by the waypoint FAYTA.

Constraints $C_1$, lateral restriction of maintaining course 223°.

$C_2$ speed restriction of flying at or below (AoB) 250 knots calibrated airspeed.

$C_3$, altitude restriction of flying at or above (AoA) 5000 ft

Objectives $O_1$, minimize cost

The initial and final states are defined by begin and end triggers, which indicate the activation and deactivation of the effect of the flight segment over the trajectory. The begin trigger of one flight segment is always linked to the end trigger of the previous flight segment. The begin trigger of the first flight segment is linked to the initial conditions of the flight. Alternatively, being trigger may be referred to as start trigger.

Flight Segments

The attributes of a flight segment are effect, execution interval and a flight segment code.

The effect provides information about the aircraft behavior during the flight segment, and could range from no information to a complete description of how the aircraft is flown during that flight segment. The effect is always characterized by a composite which is an aggregated element formed by groups of aircraft intent description language (AIM) instructions or is a combination of other composites. Since it is possible to define an effect without any specific information, the concept of a composite has been generalized to include a composite built without any AIDL instructions but is instead defined exclusively by its begin and end triggers. This definition supports the case of an unknown aircraft behavior throughout a flight segment.

Composites are the result of a concatenation of AIDL instructions following the AIDL lexical rules explained above, but need not meet the requirement for all six degrees of freedom to be closed. The effect of a flight segment on the aircraft's motion is equivalent to the aggregation of the individual effects of the AIDL instructions that make up the composite.

The execution interval defines the interval during which the flight segment is active, defining the initial aircraft state and the final aircraft state. The execution interval is fixed by means of the begin and end triggers, and these have to be the same as the begin and end triggers of the composite which define this flight segment.

Figure 6:
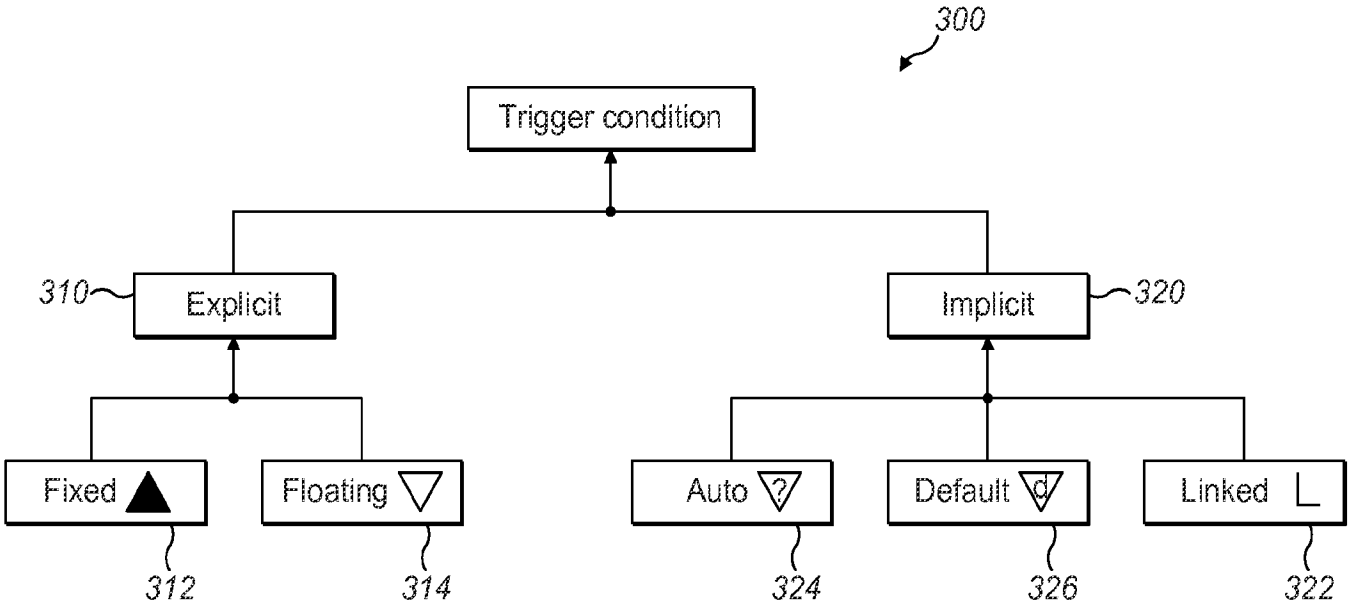
FIG. 6 is a diagram showing the different types of trigger conditions.

The begin and end triggers may take different forms, as indicated in FIG. 6. Explicit triggers 310 are divided into fixed 312 and floating 314 triggers. Implicit triggers 320 are divided into linked 322, auto 324 and default 326 triggers.

Starting with the explicit triggers, a fixed trigger refers to a specified time instant fir starting or ending an execution interval. For example, to set an airspeed at a fixed time. A floating trigger depends upon an aircraft state variable such as speed or altitude reaching a certain value to cause an execution interval to start or end. An example would be to keep airspeed below 250 knots CAS until altitude exceeds 10,000 feet.

Turning now to implicit triggers, a linked trigger is specified by reference to another flight segment, in this way, a series of triggers may create a logically ordered sequence of flight segments where the chain of start triggers is dependent upon the end trigger of a previous flight segment.

Auto triggers delegate responsibility for determining whether the conditions have been met to the trajectory computation engine. Such an arrangement is needed when the conditions are not known at the intent generation time, and will only become apparent at the trajectory computation time. An example is an aircraft tracking a VOR radial whose intent is to perform a fly-by at a constant bank angle so as to intercept another VOR radial. At the time of intent generation, there is no information on when to begin the turn. Instead, this will be computed by the trajectory computation engine (most likely by iterating on different solutions to the problem).

Default triggers represent conditions that are not known at intent generation, but are determined at trajectory computation because they rely upon reference to the aircraft performance model. The above example of a set bank angle instruction had an auto start trigger, and will have a default end trigger that will be determined by the law that defines the time evolution of the aircraft's bank angle provided by the aircraft performance model.

Flight Segment Codes

The flight segment code is an alphanumeric string which indicates the degrees of freedom of the aircraft motion that are not closed by the composite that characterized the flight segment effect. This information is used with constraints and objectives, because these elements can be combined only if they affect an open degree of freedom. Flight segment code may be formed by five or six numbers/letters, as follows. The first four digits take the values of 1 or 0 and are related to the three degrees of freedom corresponding to the configuration settings (landing gear, speed brakes and high lift devices) and the lateral degrees of freedom defining the aircraft's motion. The values indicate whether the degree of freedom is open or closed, e.g. 0 for closed and 1 for open. The following positions can be any of S, V, P, 1 or 0, to indicate that both longitudinal degrees of freedom are closed (0), both are open (1) or just one is open (combination of S V, P depending upon which degree has been closed). For the last example, the code will indicate the aspects of aircraft motion aspects that can be affected by constraints or objectives.

An example of flight segment code is 0110VP. The 0 in the first position indicates that the landing gear (LG) degree of freedom is closed. The 1 in the second position indicates that the degree of freedom relating to the speed brakes (SB) is open. The 1 in the third position indicates that the degree of freedom related to the high lift devices (HL) is open. The 0 in the fourth position indicates that the degree of freedom related to lateral motion (LT) is closed. The V and P in the fifth and sixth positions indicate that only one degree of freedom relating to the longitudinal motion is open. The letters indicate that it is possible to add a constraint or objective that affects the vertical profile (v) or the propulsive profile (P)—an S relates to the speed profile.

Composites

As described above, composites are aggregated elements formed by set of AIDL instructions or by other composites. Composites are built following the AIDL grammar rules but without the requirement to close all six degrees of freedom. Composites have three attributes, namely effect, execution interval and a composite code.

The effect is the addition of the individual effects of each AIDL instruction which define the composite. It is also possible to generate a composite without an effect. Such composites have the specific task of characterizing flight segments where the aircraft behavior is totally unknown. The execution interval defines the interval during which the composite is active. The definition of the execution interval is equivalent to what has been explained above, including the description of begin and end triggers.

The composite code condenses the information contained in the AIDL instructions that define the composite. The information encoded depends on the degrees of freedom closed by the AIDL instructions. The composite code is similar to the flight segment code. However, composite codes indicate which degrees of freedom are closed by the instructions, while the latter indicates the degrees of freedom that are open.

To classify the composites and to identity compatibility between different composites during the composition process, each composite is denoted by its composite code. The composite code gathers the grammatical information present in the AIDL instructions contained in a composite, the degrees of freedom affected and profiles present in the longitudinal degrees of freedom. A basic rule thr building valid composites is that the AIDL grammar rules should be respected during the combination of AIDL instructions, except AIDL lexical Rule 1 (see above—closure of all six degrees of freedom).

The composite code is an alphanumeric string composed of six to ten numbers/letters. The first four digits take the values of 1 (instructions present) or 0 (instructions not present), and are related to the three configuration degrees of freedom (landing gear, speed brakes and high lift devices in that order) and the lateral degree of freedom. The last four digits are a set of letters (combinations of S, V and P) that indicate if AIDL instructions relating to longitudinal motion belonging to the speed (S), vertical (V) and propulsive (P) profiles are included in the composite. A final 0 is used only if one of the two longitudinal threads is free of instructions. The composite code 1001S0 means the composite is formed by instructions for landing gear (there is a 1 at the first position), for lateral motion (there is a 1 at fourth position) and for one of the longitudinal degrees of freedom that relates only to speed (there is an S followed by a 0 at the fifth and sixth positions).

Constraints

Constraints are rules or restrictions that may limit the trajectory to be flown by the aircraft. Constraints could be self-imposed by the aircraft operator, by the operational context or by air traffic control. In any case, the final effect over the aircraft motion will be a limitation on the aircraft behavior during a certain interval.

The attributes of a constraint are effect, domain of application and an execution interval. Effect is the mathematical expression that describes the influence of the constraint on the aircraft motion. This influence is equivalent to closing one degree of freedom of the aircraft's motion with the defined equation. The domain of application defines the interval where the constraint is active and its effect is applied to the aircraft's motion. This domain can be a spatial interval, a temporal interval, or even more sophisticated intervals. Begin and end triggers indicate delimit the execution interval. The begin and end triggers of any constraint are linked to the begin and end triggers of the related flight segment(s). These triggers do not define where the constraint is affecting aircraft motion, only when they may be active. It is the domain of application that defines when the constraint is affecting aircraft motion.

Constraints may be classified according to the degree of freedom affected by the constraint effect. This is useful as it defines whether it can be applied to a flight segment (i.e. whether that degree of freedom is open and so available).

Speed profile constraints (SPC) are those constraints whose effect imposes a condition to a degree of freedom related to the speed profile.

Vertical profile constraint (VPC) are those constraints whose effect imposes a condition to a degree of freedom related to the vertical profile.

Propulsive profile constraint (PPC) are those constraints whose effect imposes a condition to a degree of freedom related to the propulsive profile.

Lateral profile constraint (LPC) are those constraints whose effect imposes a condition to a degree of freedom related to the lateral profile.

Landing gear profile constraint (LGPC) are those constraints whose effect imposes a condition to a degree of freedom related to the landing gear profile Speed brakes profile constraint (SBPC) are those constraints whose effect imposes a condition to a degree of freedom related to the speed brakes profile.

High lift devices profile constraint (HLDC) are those constraints whose effect imposes a condition to a degree of freedom related to the high lift devices profile.

Time constraint (TMC) are those constraints whose effect imposes a fixed time for a determined aircraft state, e.g. requested time of arrival at a waypoint. This constraint is not directly linked with a degree of freedom of the aircraft's motion, but it is a condition imposed to the trajectory and must necessarily affect at least one degree of freedom.

Objectives

Objectives represent a wish to affect the aircraft's motion to optimize a certain objective functional over a certain domain of application. These functions may encode a specific airline business strategy or a pilot procedure. The attributes of an objective are effect, variables of control, domain of application and execution interval.

The effect is the mathematical expression that describes the influence of the objective on the aircraft motion. Objectives are defined as a functional whose optimization drives the process of finding the most appropriate trajectory. The functional may define explicitly the variable or variables used for the optimization, and may return the value for them that minimizes or maximizes the functional. For example, the objective minimum cost could be expressed as a functional which evaluates the operational cost of the trajectory with the speed as a variable to be used for the optimization.

The variables of control are the variables that will be explicitly used in the optimization. Obtaining the maximum or minimum of the defined functional returns a function of the variables of control which satisfy the maximization or minimization criterion. These variables are related to the degrees of freedom of the aircraft's motion used to achieve the functional. Therefore, they specify the intention of using one or more degrees of freedom to achieve the optimization. When no variable of control is defined, the aircraft intent generation process will use any remaining open degree freedom to achieve the optimization.

The domain of application defines the interval where the objective is active and affecting aircraft motion. This domain can be a spatial interval, a temporal interval or even more sophisticated intervals.

The execution interval is delimited by begin and end triggers that indicate when the objective may be active and affecting aircraft motion.

Objectives may be classified considering the degree of freedom that can be affected by the objective effect.

Speed profile objectives (SPO) are those objectives whose effect imposes a condition to a degree of freedom related to the speed profile.

Vertical profile objectives (VPO) are those objectives whose effect imposes a condition to a degree of freedom related to the vertical profile.

Propulsive profile objectives (PPO) includes those objectives whose effect imposes a condition to a degree of freedom related to the speed profile.

Lateral profile objectives (LPO) are those objectives whose effect imposes a condition to a degree of freedom related to the lateral profile.

Landing gear profile objectives (LGPO) are those objectives whose effect imposes a condition to a degree of freedom related to the landing gear profile.

Speed brakes profile objectives (SBPO) are those objectives whose effect imposes a condition to a degree of freedom related to the speed brakes profile.

High lift devices profile objectives (HLPO) are those objectives whose effect imposes a condition to a degree of freedom related to the high lift devices profile.

Multiple profile objectives (MPO) are those objectives whose effect imposes a condition to a degree of freedom although that degree is not fixed. These objectives do not impose an optimization over a specific profile. As a result, the most appropriate open degree of freedom not closed by a flight segment, constraint or other objective may be used.

Grammar of the FIDL

The FIDL grammar is divided in lexical and syntactical rules. The former contains a set of rules that governs the creation of valid words using flight segments, constraint and objectives. The latter contains a set of rules for the generation of valid FIDL sentences.

The lexical rules consider the flight segments as the FIDL lexemes, i.e. the minimal and indivisible element that is meaningful by itself. Constraints and objectives are considered as FIDL prefixes (or suffixes) which complement and enhance the meaning of the lexemes but do not have any sense individually. Therefore the lexical rules describe how to combine the lexemes with the prefixes in order to ensure the generation of a valid FIDL string. They also determine whether a string formed by lexemes and prefixes is valid in the FIDL.

The lexical rules are based on the open and closed degrees of freedom that characterize a flight segment. If the flight segment has no open degree of freedom, it means that the associated lexemes are totally meaningful and their meaning cannot be complemented by any prefix (constraint or Objective). For lexemes whose flight segments have one or more open degrees of freedom, as many prefixes as open degrees of freedom may be added. The lexical rules also allow flight segments and associated constraints and Objectives in which one or more degrees of freedom are left open. In this case, it is possible to close later the degrees of freedom by adding constraints or objectives.

Considering the above mentioned definition for lexemes and prefixes, the lexical rules that govern the formation of valid FIDL string are summarized below.

LR1 A valid FIDL word shall be composed by at least one flight segment.

LR2 A flight segment with all degrees of freedom closed cannot be simultaneously active with any constraint or objective.

LR3 Constraints and objectives that affect the same degree of freedom cannot be simultaneously active: speed profile constraint and speed profile objective; vertical profile constraint and vertical profile objective; propulsive profile constraint and propulsive profile objective; lateral profile constraint and lateral profile objective; landing gear profile constraint and landing gear profile objective; speed brakes profile constraint and speed brakes profile objective; high lift devices profile constraint and high lift devices profile objective.

LR4 speed profile constraint and speed profile objective can only be simultaneously active with those flight segments with at least one longitudinal degree of freedom open and no speed profile instructions active in the flight segment effect.

LR5 Vertical profile constraint or vertical profile objective can only be simultaneously active with those flight segments with at least one longitudinal degree of freedom open and no vertical profile instructions active in the flight segment effect.

LR6 Propulsive profile constraint and propulsive profile objective can only be simultaneously active with those flight segments with at least one longitudinal degree of freedom open and no propulsive profile instructions active in the flight segment effect.

LR7 Lateral profile constraint and lateral profile objective can only be simultaneously active with those flight segments with at least one longitudinal degree of freedom open and no lateral profile instructions active in the flight segment effect.

LR8 Landing gear profile constraint and landing gear profile objective can only be simultaneously active with those flight segments with at least one longitudinal degree of freedom open and no landing gear profile instructions active in the flight segment effect.

LR9 Speed brakes profile constraint and speed brakes profile objective can only be simultaneously active with those flight segments with at least one longitudinal degree of freedom open and no speed brakes profile instructions active in the flight segment effect.

LR10 High lift devices profile constraint and high lift devices profile objective can only be simultaneously active with those flight segments with at least one longitudinal degree of freedom open and no high lift profile instructions active in the flight segment effect).

Turning now to the FIDL syntactical rules, these are the rules that are used to identify if a sentence formed by FIDL words is valid or not.

A well-formed FIDL sentence is defined by a sequence of concatenated flight segments that represent a chronological succession of aircraft motion states. These aircraft states are requirements over the trajectory whose definition is set by the triggers of the flight segments.

Special consideration must be given to time constraints because they do not affect directly a specific degree of freedom. Taking into account that the domain of application of time constraint is always associated with an event (e.g. specific time when reaching a waypoint, an altitude, or a speed), any degree of freedom available in any flight segment prior to the time constraint may be used to attain the time of that event. Therefore, the necessary condition to associate a time constraint to a flight segment is that one of its degrees of freedom has to be open. When this constraint is applied, the flight segment reduces the number of open degrees of freedom. If a time constraint is associated to a sequence of flight segments, the necessary condition is that one or more of the flight segments from amongst the sequence has at least one open degree of freedom.

The situation of the multiple profile objectives is similar to that of time constraints. When multiple profile objectives are associated to a flight segment or a sequence of flight segments, the necessary condition is to have an open degree of freedom that will be closed by the effect of the objective. As for all constraints and objectives, applying a multiple profile objective to a flight segment reduces the number of open degrees of freedom: when it is associated to a sequence of flight segments, the reduction will be applied to all flight segments in the sequence that have an open degree of freedom.

Considering the definition of the elements of the language and the lexical rules which applied to them, the HDL syntactical rules which establish the validity of a sentence built using the FIDL words are summarized below.

SR1 A valid FIDL sentence is formed by at least one flight segment.

SR2 The begin trigger of a flight segment is always linked to end trigger of the previous flight segment, apart from the very first begin trigger that is defined by the initial conditions.

SR3 A constraint or objective can be associated to a flight segment sequence only when it does not violate any lexical rule for each flight segment of the chain.

SR4 Time constraints can only be associated to a flight segment in where there is at least one open degree of freedom not affected by any other constraint or objective, either in the flight segment where the time constraint applies or in any previous flight segment.

SR5 No more than one time constraint may be applied to the same flight segment.

SR6 Multiple profile objectives may only be associated to a flight segment sequence in which there is at least one open degree of freedom in the sequence not affected by any other constraint or objective.

Contemplated Applications

The present invention may find utility on any application that requires prediction of an aircraft's trajectory, and where the information required to generate the flight intent is available (either at the time or later when the trajectory computation is actually performed).

For example, the trajectory computation infrastructure 110 may be provided as part of a flight management system of an aircraft. The flight management system may make use of the trajectory prediction facility when determining how the aircraft is to be flown. For example, the flight management system may adopt an iterative approach to flight planning. A trajectory may be predicted and compared to objectives such as the airline's business objectives (minimum flight time, minimum fuel burn, etc.). The details of the flight plan may be adjusted and the result on the predicted trajectory determined and compared to the objectives.

A trajectory predicted as described in the preceding paragraph may be provided to air traffic management, akin to the provision of a detailed flight plan. The present invention has particular utility where the aircraft and air traffic management systems are not compatible. Using the present invention, the flight or aircraft intent expressed in the flight/aircraft intent description language may be passed from aircraft to air traffic management. Air traffic management may then use the intent to predict the aircraft's trajectory using its own system.

For an air-based trajectory computation infrastructure, the flight management system may have access to some of the information required to generate the aircraft intent. For example, airline preferences may be stored locally for retrieval and use. Moreover, the aircraft performance model and Earth model may be stored locally and updated as necessary. Further information may be input by the pilot, for example the particular SID, navigation route and STAR to be followed, as well as other preferences like when to deploy landing gear, change flap settings, engine ratings, etc. Some missing information may be assumed, e.g. flap and landing gear deployment times based on recommended airspeed.

All this required information may be acquired before a flight, such that the trajectory of the whole flight may be predicted. Alternatively, only some of the information may be acquired before the flight and the rest of the information may be acquired en route. This information may be acquired (or updated, if necessary) following a pilot input, for example in response to a change in engine rating or flight level. The trajectory computation infrastructure may also update the predicted trajectory, and hence the aircraft intent as expressed in the aircraft intent description language, due to changes in the prevailing atmospheric conditions, as updated through the Earth model. Updates may be communicated via any of the types of well-known communication link 230 between the aircraft and the ground: the latest atmospheric conditions may be sent to the aircraft and the revised aircraft intent or predicted trajectory may be sent from the aircraft.

Air traffic management applications will be similar to the above described air-based system. Air traffic management may have information necessary to determine aircraft intent, such as flight procedures (SIDs, STARs, etc), information relating to aircraft performance (as an aircraft performance model), atmospheric conditions (as an Earth model), and possibly even airline preferences. Some information, such as pilot preferences relating to for example when to change the aircraft configuration, may be collected in advance of a flight or during a flight. Where information is not available, air traffic management may make assumptions in order for the aircraft intent to be generated and the trajectory to be predicted. For example, an assumption may be made that all pilots will deploy their landing gear ten nautical miles from a runway threshold or at a particular airspeed.

In an embodiment of a computer-implemented method of air traffic management, the predicted trajectory of one or more aircraft may be compared to identify potential conflicts. Any potential conflicts may be resolved by advising one or more of the aircraft of necessary changes to their flight/aircraft intent.

In another embodiment, a method of avoiding aircraft collisions may comprise receiving a set of instructions expressed in a formal language that relate to the aircraft intent of another aircraft, predicting the trajectory of the other aircraft, and comparing the two predicted trajectories to identify any conflicts in the trajectories.

The person skilled in the art will appreciate that variations may be made to the above described embodiments without departing from the scope of the invention defined by the appended claims.

The invention claimed is:

1. A method, implemented by a computational infrastructure, of providing a description of a flight intent of an aircraft to be flown on a flight expressed using a formal language, the method comprising:

receiving at an input of the computational infrastructure information describing how the aircraft is to be flown including motion information that describes the motion of the aircraft and configuration information that describes an aerodynamic configuration of the aircraft, and storing the information in a database;

dividing, by the computational infrastructure, the flight onto one or more flight segments having one or more constraints and one or more objectives, wherein the one or more flight segments represent an intent of changing an aircraft motion state from one state into another, the one or more constraints represent a restriction on a trajectory of the aircraft, and the one or more objectives represent a desire relating to the trajectory to maximize or minimize a certain function;

for each flight segment following, by the computational infrastructure, a set of rules, using the computational infrastructure, that govern the creation of valid words using the flight segment, the one or more constraints for the flight segment, and the one or more objectives for the flight segment to express the flight intent using a formal language made up of the valid words which defines which degrees of freedom of motion of the aircraft are defined during the flight segment and which degrees of freedom of motion are not defined during the flight segment;

for each flight segment following, by the computational infrastructure, a set of attributes, being an effect, an execution interval, and a flight segment code that govern the creation of the valid words, the effect comprising aircraft behavior exhibited during the flight segment represented by a composite, the execution interval defining an interval during which the flight segment is active defining an initial aircraft state and a final aircraft state, and the flight segment code comprising an alphanumeric string wherein each letter or number in the alphanumeric string represents one of the degrees of freedom of the motion of the aircraft; and transmitting the flight intent of the aircraft using the formal language to the aircraft, to another aircraft, or to an air traffic manager.

2. The method of claim 1, wherein there is provided the further step of providing information that expresses the flight intent for one of the flight segments so as to define the effect on aircraft motion during that flight segment.

3. The method of claim 1, wherein said step of dividing, by the computational infrastructure, the flight into one or more flight segments is responsive to begin and end triggers in the computational infrastructure, and wherein each begin trigger is linked to an immediately preceding end trigger with the exception of the first begin trigger.

4. The method of claim 1, wherein there is provided the further step of providing information that expresses the flight intent for one of the flight segments using the flight segment code that defines which of the degrees of freedom of motion of the aircraft are defined during the flight segment and which of the degrees of freedom of motion are not defined during the flight segment.

5. The method of claim 1, wherein said step of for each flight segment following, by the computational infrastructure, the set of rules to express the flight intent using the formal language further comprises defining the one or more constraints by the effect that the one or more constraints has on the aircraft's motion.

6. The method of claim 5, wherein said step of for each flight segment following, by the computational infrastructure, the set of rules to express the flight intent using the formal language further comprises defining the one or more objectives by the effect that the one or more constraints has on the aircraft's motion that is to be optimized.

7. The method of claim 1, wherein the set of rules specifies that the one or more constraints and the one or more objectives may be defined only if an associated degree of freedom is open during that flight segment.

8. The method of claim 1, wherein said step of for each flight segment following, by the computational infrastructure, the set of rules to express the flight intent using the formal language further comprises defining instructions of aircraft intent.

9. The method of claim 1, further comprising for each constraint following, by the computational infrastructure, the set of attributes, being the effect, a domain of application, and the execution interval, the effect comprising a mathematical expression defining an influence of the constraint on the motion of the aircraft, the domain of the application comprising the interval where the constraint is active and in which its effect is applied to the motion of the aircraft, and the execution interval indicating when the constraint is considered active in a trajectory prediction process.

10. The method of claim 1, further comprising for each objective following, by the computational infrastructure, the set of attributes, being the effect, a domain of application, and the execution interval, the effect comprising a mathematical expression defining an influence of the objective in the motion of the aircraft, the domain of application defining the interval where the objective is active and in which its effect is applied to the motion of the aircraft, and the execution interval indicating when the objective is considered active in a trajectory prediction process.

11. A method, implemented by a computational infrastructure, of predicting the trajectory of an aircraft, the method comprising:

following a set of rules that govern the creation of valid words based on a flight segment, one or more constraints for the flight segment, and one or more objectives for the flight segment to express a flight intent of the aircraft using a formal language made up of the valid words which defines which degrees of freedom of motion of the aircraft are defined during the flight segment and which degrees of freedom of motion are not defined during the flight segment, wherein the flight segment represents an intent of changing an aircraft motion state from one state into another, the one or more constraints represent a restriction on the trajectory of the aircraft, and the one or more objectives represent a desire relating to the trajectory to maximize or minimize a certain function;

for each flight segment following a set of attributes, being an effect, an execution interval, and a flight segment code that govern the creation of the valid words, the effect comprising aircraft behavior exhibited during the flight segment represented by a composite, the execution interval defining an interval during which the flight segment is active defining an initial aircraft state and a final aircraft state, and the flight segment code comprising an alphanumeric string wherein each letter or number in the alphanumeric string represents one of the degrees of freedom of the motion of the aircraft;

reading data providing a description of the flight intent expressed using the formal language;

obtaining further information such that an unambiguous description of the aircraft's trajectory during the flight is provided;

expressing, by the computational infrastructure, the aircraft intent using the formal language to provide the unambiguous description of the aircraft's trajectory;

solving, by the computational infrastructure, equations of motion in the computational infrastructure to define aircraft motion using the expression of aircraft intent and with reference to an aircraft performance model and an earth model; and transmitting, by the computational infrastructure, a description of the predicted trajectory to the aircraft, to another aircraft, or to an air traffic manager.

12. The method of claim 11, wherein the step of expressing, by the computational infrastructure, the aircraft intent using the formal language comprises the step of providing at least one of the information necessary or references to where the information may be found, the information being necessary to perform the step of solving the equations of motion that describe aircraft flight and to compute the aircraft's trajectory.

13. The method of claim 11, further comprising:

receiving, with the computational infrastructure, a set of instructions expressed in the formal language that relate to the aircraft intent of another aircraft; and comparing, with the computational infrastructure, predicted trajectories to identify conflicts in the predicted trajectories.

14. An aircraft trajectory predictor system, comprising:

an input of a computational infrastructure configured to receive data corresponding to a description of flight intent expressed using a formal language made up of valid words formed by following a set of rules applied to a flight segment, one or more constraints for the flight segment, and one or more objectives for the flight segment defining which degrees of freedom of motion of an aircraft are defined during the flight segment and which degrees of freedom of motion are not defined during the flight segment, wherein the flight segment represents an intent of changing an aircraft motion state from one state into another, the one or more constraints represent a restriction on a trajectory of the aircraft, and the one or more objectives represent a desire relating to the trajectory to maximize or minimize a certain function, wherein the data corresponding to the description of the flight intent expressed using the formal language made up of the valid words is further formed for each flight segment following a set of attributes, being an effect, an execution interval, and a flight segment code that govern the creation of the valid words, the effect comprising aircraft behavior exhibited during the flight segment represented by a composite, the execution interval defining an interval during which the flight segment is active defining an initial aircraft state and a final aircraft state, and the flight segment code comprising an alphanumeric string wherein each letter or number in the alphanumeric string represents one of the degrees of freedom of the motion of the aircraft;

a further input of a computational infrastructure configured to receive further information such that an unambiguous description of the aircraft's trajectory during the flight is provided;

an output of a computational infrastructure configured to produce a formal language expression corresponding to an aircraft intent, the formal language expression corresponding to the unambiguous description of the aircraft's trajectory;

a trajectory engine of a computational infrastructure configured to solve equations of motion defining aircraft motion using the formal language expression of aircraft intent and with reference to an aircraft performance model and an earth model; and a further output of a computational infrastructure configured to transmit information corresponding to a description of the predicted trajectory to the aircraft, to another aircraft, or to an air traffic manager.

15. The system of claim 14, comprising an aircraft model data input of a computational infrastructure configured to receive at least one of information necessary or references to where the information may be found, the information being necessary to solve the equations of motion describing aircraft flight for a plurality of aircraft and to compute a predicted trajectory for each of the plurality of aircraft.

16. The system of claim 15, wherein the computational infrastructure is configured to compare the predicted trajectories to identify potential trajectory conflicts between the plurality of aircraft.

17. A computer-implemented method of providing a description of flight intent of an aircraft to be flown on a flight expressed using a formal language, the method comprising:

receiving at an input of a computational infrastructure information describing how the aircraft is to be flown including motion information and configuration information;

dividing the flight into one or more flight segments having one or more constraints and one or more objectives, wherein the one or more flight segments represent an intent of changing an aircraft motion state from one state into another, the one or more constraints represent a restriction on a trajectory of the aircraft, and the one or more objectives represent a desire relating to the trajectory to maximize or minimize a certain function;

providing at an output of the computational infrastructure information that expresses the flight intent for each flight segment using a formal language, which follows a set of rules to govern the creation of valid words using the flight segment, the one or more constraints for the flight segment, and the one or more objectives for the flight segment, to define which degrees of freedom of motion of the aircraft are defined during the flight segment and which degrees of freedom of motion are not defined during the flight segment;

for each flight segment following a set of attributes, being an effect, an execution interval, and a flight segment code that govern the creation of the valid words, the effect comprising aircraft behavior exhibited during the flight segment represented by a composite, the execution interval defining an interval during which the flight segment is active defining an initial aircraft state and a final aircraft state, and the flight segment code comprising an alphanumeric string wherein each letter or number in the alphanumeric string represents one of the degrees of freedom of the motion of the aircraft; and transmitting the flight intent of the aircraft using the formal language to the aircraft, to another aircraft, or to an air traffic manager.

18. The computer-implemented method of claim 17 further comprising the further step of determining in the computational infrastructure the degrees of freedom of motion of the aircraft that are defined by the information stored for that flight segment.

19. The computer-implemented method of claim 17 further comprising deriving aircraft intent from the flight intent and using the aircraft intent to generate a predicted trajectory in the computational infrastructure for the aircraft.

20. The computer-implemented method of claim 19 further comprising comparing the predicted trajectory of the aircraft to another predicted trajectory of another aircraft in order to identify potential trajectory conflicts.

21. The computer-implemented method of claim 20 further comprising resolving potential trajectory conflicts by advising one or more of the aircraft of necessary changes to their flight intent or their aircraft intent.

22. The method of claim 17 further comprising providing at an output of the computational infrastructure information that expresses the flight intent for one of the flight segments so as to define the effect on aircraft motion during that flight segment.

* * * * *